US006539661B2

(12) United States Patent
Hope

(10) Patent No.: US 6,539,661 B2
(45) Date of Patent: Apr. 1, 2003

(54) OPTICAL IMAGING DEVICE FOR FIREARM SCOPE ATTACHMENT

(76) Inventor: Richard W. Hope, 1508 Kline St., Denham Springs, LA (US) 70726

( * ) Notice: Subject to any disclaimer, the term of this patent is extended or adjusted under 35 U.S.C. 154(b) by 0 days.

(21) Appl. No.: 09/757,481

(22) Filed: Jan. 11, 2001

(65) Prior Publication Data

US 2002/0002788 A1 Jan. 10, 2002

Related U.S. Application Data

(60) Provisional application No. 60/176,026, filed on Jan. 14, 2000.

(51) Int. Cl.[7] ..... F41G 1/38
(52) U.S. Cl. ..... 42/119; 89/41.05; 89/41.17
(58) Field of Search ..... 42/119, 120, 131; 89/41.05, 41.17

(56) References Cited

U.S. PATENT DOCUMENTS

| | | | | | |
|---|---|---|---|---|---|
| 3,545,356 | A | * | 12/1970 | Nielsen | 42/119 |
| 3,785,261 | A | * | 1/1974 | Ganteaume | 95/12 |
| 4,290,219 | A | | 9/1981 | Boller et al. | 354/76 |
| 4,370,914 | A | * | 2/1983 | Voles | 89/41.05 |
| 4,835,621 | A | | 5/1989 | Black | 358/335 |
| 5,020,262 | A | * | 6/1991 | Pena | 42/106 |
| 5,054,225 | A | * | 10/1991 | Giuffre et al. | 42/101 |
| D332,457 | S | | 1/1993 | Zepp | D16/132 |
| 5,287,644 | A | | 2/1994 | Bolduc | 42/106 |
| 5,711,104 | A | | 1/1998 | Schmitz | 42/100 |
| 5,887,375 | A | | 3/1999 | Watson | 42/106 |
| 5,932,872 | A | | 8/1999 | Price | 345/6 |
| 5,937,562 | A | * | 8/1999 | Brough | 42/103 |
| 5,938,717 | A | | 8/1999 | Dunne et al. | 340/937 |

FOREIGN PATENT DOCUMENTS

| | | |
|---|---|---|
| GB | 2248287 | 4/1992 |

* cited by examiner

*Primary Examiner*—Stephen M. Johnson
(74) *Attorney, Agent, or Firm*—Richard C. Litman

(57) ABSTRACT

The present optical imaging device comprises an electro-optical recording device, such as a digital still camera, videotape recorder, etc, physically and optically connected to the scope sight of a firearm. The scope may be provided with a half silvered mirror at the eyepiece, which reflects a portion of the image passing through the scope to the axially offset recording device. The user of the firearm and optical system may thus continue to view the image through the scope. Other embodiments provide a small, light weight micro camera fitted to the scope eyepiece, with the camera receiving the image from the eyepiece and providing that image to the user through a rearward viewing screen. A switch may be provided to operate the system upon trigger actuation, or independently of the firearm trigger. The system is particularly valuable in sighting in a weapon or harmlessly capturing an image of an animal.

6 Claims, 4 Drawing Sheets

OPTICAL IMAGING DEVICE FOR FIREARM SCOPE ATTACHMENT

CROSS-REFERENCE TO RELATED APPLICATION

This application claims the benefit of U.S. Provisional Patent Application Ser. No. 60/176,026, filed Jan. 14, 2000 now abandoned.

BACKGROUND OF THE INVENTION

1. Field of the Invention

The present invention relates generally to optical imaging devices such as digital still cameras and video recording cameras, and more specifically to such a device or system which is attachable to the scope of a hunting rifle or other weapon to record images viewed through the scope. The present optical system enables a hunter or other person to view the image through the scope by means of a partially silvered mirror which reflects the image to the optical recording device, or through the viewing lens of a television video microcamera affixed to the eyepiece of the scope.

2. Description of the Related Art

Over human history, hunting has evolved from a necessary part of life to an enjoyable hobby or pastime for many people. While very few people need to hunt in order to provide food for themselves or family, many hunters still enjoy the challenge of the hunt and the thrill of taking a game animal.

In many cases, a hunter may not wish to kill the game he or she is hunting, but may only wish to have a record of a successful hunt, i.e., a hunt culminating in an encounter with the hunted animal which could have resulted in the taking of the animal had the hunter so desired. In other cases, it may not be legal to kill a given animal due to its status as an endangered species, certain geographical and/or seasonal limits, previously reached bag or quota limits, etc. Nevertheless, the hunter will still enjoy the thrill of the hunt, only to be frustrated that he or she cannot take the animal being hunted.

Even in those instances where a hunter is attempting to take an animal, it can be difficult in the field to confirm the accurate placement of a given shot. While all hunters make every attempt to make a killing shot the first time, this is not always the case due to movement of the animal and/or hunter, deflection of the bullet due to wind, brush, etc., and/or other factors. A wounded game animal must be tracked down and killed, and often the hunter has difficulty determining the exact placement of the shot in order to determine the likely outcome of such a situation for recovering the wounded animal, i.e., making an educated guess as to how far the animal might travel and its likely reactions to the wound.

Also, in many cases a hunter will be certain that the shot was accurate, only to find that the shot went astray or only wounded the animal. With no means of recording the sight picture through the scope, the hunter can never be absolutely sure of the accuracy of a given shot.

Accordingly, a need will be seen for an optical imaging system or device which captures the image viewed through the scope of a rifle or other hunting firearm or weapon, for later viewing. The present invention provides various embodiments of such a device or system, and enables the hunter to view the image provided at the eyepiece of a firearm scope simultaneously with the recording of that image, either by still or motion video recording means. The optical image may be viewed directly by the hunter by means of a partially silvered mirror at the eyepiece of the scope, allowing the hunter to view the image through the scope while still reflecting that image laterally to a camera, or may alternatively be viewed through the display screen of a microcamera placed at the eyepiece of the scope.

A discussion of the related art of which the present inventor is aware, and its differences and distinctions from the present invention, is provided below.

U.S. Pat. No. 4,290,219 issued on Sept. 22, 1981 to Hans Boller et al., titled "Target Sight Recording Apparatus," describes a mechanism for attaching an "instant" camera (e. g., Polaroid, tm) to the eyepiece end of a firearm scope. The optical axis of the camera is offset by about 90 degrees to that of the scope, with a partially silvered mirror or the like reflecting about half of the image of the scope to the camera, with the remaining image being visible through the eyepiece of the scope.

Boller et al. further provide a relatively complex system for recording a series of four images on a single sheet of film. The present device does not use photochemical means for recording the images, but rather uses electronic means and thus is not concerned with the recording of multiple images upon a single sheet of photochemically receptive film. Moreover, the Boller et al. device is devoid of any electronic means of operation, and uses a mechanical linkage between the gun trigger and the camera. In contrast, the present device utilizes completely electronic means for connecting the optical recording means with the trigger of the firearm, and moreover provides a supplemental switch for recording the image visible through the scope when actuating the firearm trigger is not desired.

U.S. Pat. No. 4,835,621 issued on May 30, 1989 to John W. Black, titled "Gun Mounted Video Camera," describes a specially constructed structure for holding a video camera, with a firearm scope mounted to the structure through which the video camera is aimed or sighted. The Black device is not at all a firearm; the gun barrel and action of the device are not operable. Moreover, the barrel is axially offset from the central portion of the structure, where the firearm action would normally be located, unlike the concentric arrangement of components in a conventional firearm. In contrast, the present invention provides means for recording the optical image viewed through the firearm scope of an actual firearm (hunting rifle, etc.). It is also noted that Black provides a view for the operator only by means of an axially offset viewfinder for the video camera, rather than allowing the operator to sight through the scope, as in the present invention.

U.S. Pat. No. 5,287,644 issued on Feb. 22, 1994 to Bruce L. Bolduc, titled "Camera Rifle Organization," describes an apparatus using a rifle-like stock with a vertical camera passage formed therein, for removably holding a conventional camera using photochemical film. As in the apparatus of the '621 U.S. Patent to Black discussed above, the Bolduc apparatus (a) does not use an actual firearm, as does the present invention; (b) uses a mechanical camera actuating system, unlike the electrical actuation used in the present invention; and (c) the simulated firearm structure cannot be used as such when the camera apparatus is removed, whereas the present invention attaches removably to a conventional firearm which may be used as such either with the optical imaging system attached or removed from the firearm.

U.S. Pat. No. 5,711,104 issued on Jan. 27, 1998 to Geoffrey W. Schmitz, titled "Small Arms Visual Aiming System, A Method for Aiming A Firearm, And Headgear For Use Therewith," describes a system wherein the imaging receiver is attached to and aligned with the firearm axis, as in the present device. However, the visual image is not aligned with the firearm, but is remotely located therefrom in an article of headgear (helmet, etc.) worn by the user of the firearm, unlike the present invention. In this manner, the user of the firearm need not expose his or her head or upper body to align the firearm, but may remain concealed while viewing the image aligned with the firearm. No automatic trigger actuated switch for actuating the video apparatus is provided by Schmitz; the video apparatus must be actuated by a separate switch.

U.S. Pat. No. 5,887,375 issued on Mar. 30, 1999 to Jerry W. Watson, titled "Camera Mount For Firearms," describes a structure for mechanically attaching a video camera to the scope of a hand held firearm. However, Watson (a) does not provide any automated means of actuating the video camera when the firearm trigger is pulled; (b) does not align the video camera with the optical axis of the scope to view the image provided by the scope; and (c) does not provide the same image to the user of the apparatus as that provided at the eyepiece of the scope. The present apparatus responds to each of the above problems by aligning the optical recording device with the eyepiece of the scope, and also providing automatic actuation means for the optical system when the firearm trigger is pulled.

U.S. Pat. No. 5,932,872 issued on Aug. 3, 1999 to Jeffrey H. Price, titled "Autofocus System For Scanning Microscopy Having A Volume Image Formation," describes a camera system in combination with an optical microscope. A dichroic mirror allows passage of predetermined light colors or frequencies to a viewer, while reflecting other frequencies to a camera for recording the image. The camera and microscope of the Price system are integrated with one another; the camera cannot be detached, as in the present system. The Price system is not adaptable to a firearm, nor is any means provided for automatically actuating the camera system when another event (e.g., firing an attached firearm) occurs, as provided by the present optical imaging device with its firearm scope attachment and multiple triggering or actuating means.

U.S. Pat. No. 5,938,717 issued on Aug. 17, 1999 to Jeremy G. Dunne et al., titled "Speed Detection And Image Capture System For Moving Vehicles," describes a laser speed detection system with optical camera. While the Dunne et al. system allows the laser unit to be actuated manually as well as automatically, there is no such provision for operating the optical camera. Rather, the camera may only be actuated automatically when the laser detector triggers operation of the camera. No firearm is provided with the system, for obvious reasons, and correspondingly, no telescopic sight is provided with the Dunne et al. system.

U.S. Pat. No. Des.332,457 issued on Jan. 12, 1993 to Clyde L. Zepp, titled "Camera For Mounting On A Rifle Scope," illustrates a design for a camera body which is mounted in the scope body, in series with the optical lenses of the scope. No means of electronically recording or displaying any images obtained, nor of automatically triggering the operation of the camera by actuation of the firearm, is apparent in the Zepp design.

Finally, British Patent Publication No. 2,248,287 published on Apr. 1, 1992, titled "Sighting Device," describes an alignment system for adjusting the view for the elevation of a gun in a turret, as opposed to the present device for use with hand held firearms. No means for recording images or scope attachment is provided. Moreover, no trigger system for actuating any form of optical recording device is provided.

None of the above inventions and patents, either singly or in combination, is seen to describe the instant invention as claimed.

SUMMARY OF THE INVENTION

The present invention comprises an optical imaging device for attachment to the magnifying scope sight of a hand held firearm. The present apparatus attaches to the eyepiece of the scope and receives magnified visual images which pass through the scope. The person using the firearm may view the image through the scope attachment, either by means of a half silvered mirror which reflects a portion of the image to an electro-optical recording device (digital camera, video recorder, etc.) or by means of the viewing screen of a video micro camera secured to the eyepiece of the scope. The system is actuated automatically for a predetermined time or number of frames when the trigger of the weapon is pulled, by means of a microswitch positioned behind the trigger. Alternatively, a secondary switch may be provided at some convenient location for the user of the weapon to actuate the optical system without firing the weapon, if so desired.

When the present optical imaging device is properly adjusted with its associated scope and firearm, it provides a hunter with an accurate sight picture of the aiming point of the firearm when the trigger is pulled, thus eliminating much of the guesswork in sighting in a weapon and/or determining the precise placement of a bullet in a hunted animal if the animal is wounded. Images may be viewed essentially immediately after creation by the review and/or playback functions associated with such equipment, with the shooter viewing the images through the eyepiece viewing screen or other viewing means associated with the optical or video recording system.

Accordingly, it is a principal object of the invention to provide an improved optical imaging device for firearm scope attachment, for recording the visual image received by the firearm scope at the time the optical system is actuated.

It is another object of the invention to provide an improved optical imaging device wherein the imaging device and hunter or shooter both receive the same optical image as viewed from the eyepiece of the scope, with the viewing eye of the hunter or shooter being aligned with the optical axis of the scope.

It is a further object of the invention to provide an improved optical imaging device with an optical recording means which may comprise a digital still camera or a video recorder.

An additional object of the invention is to provide an improved optical imaging device which optical recording means may be offset from the optical axis of the scope and receive a reflected video image, or which may comprise a micro camera secured to the eyepiece of the scope and optically aligned therewith.

Still another object of the invention is to provide an improved optical imaging device which may be incorporated integrally with a firearm scope and firearm, as desired.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of an optical imaging device which is removably attachable to the telescopic sight of a hand held firearm. The device permits the hunter or shooter to capture a video image of the game or other target when the weapon is fired, or alternatively to capture an image through the scope without firing the weapon, if so desired.

Figure 1:
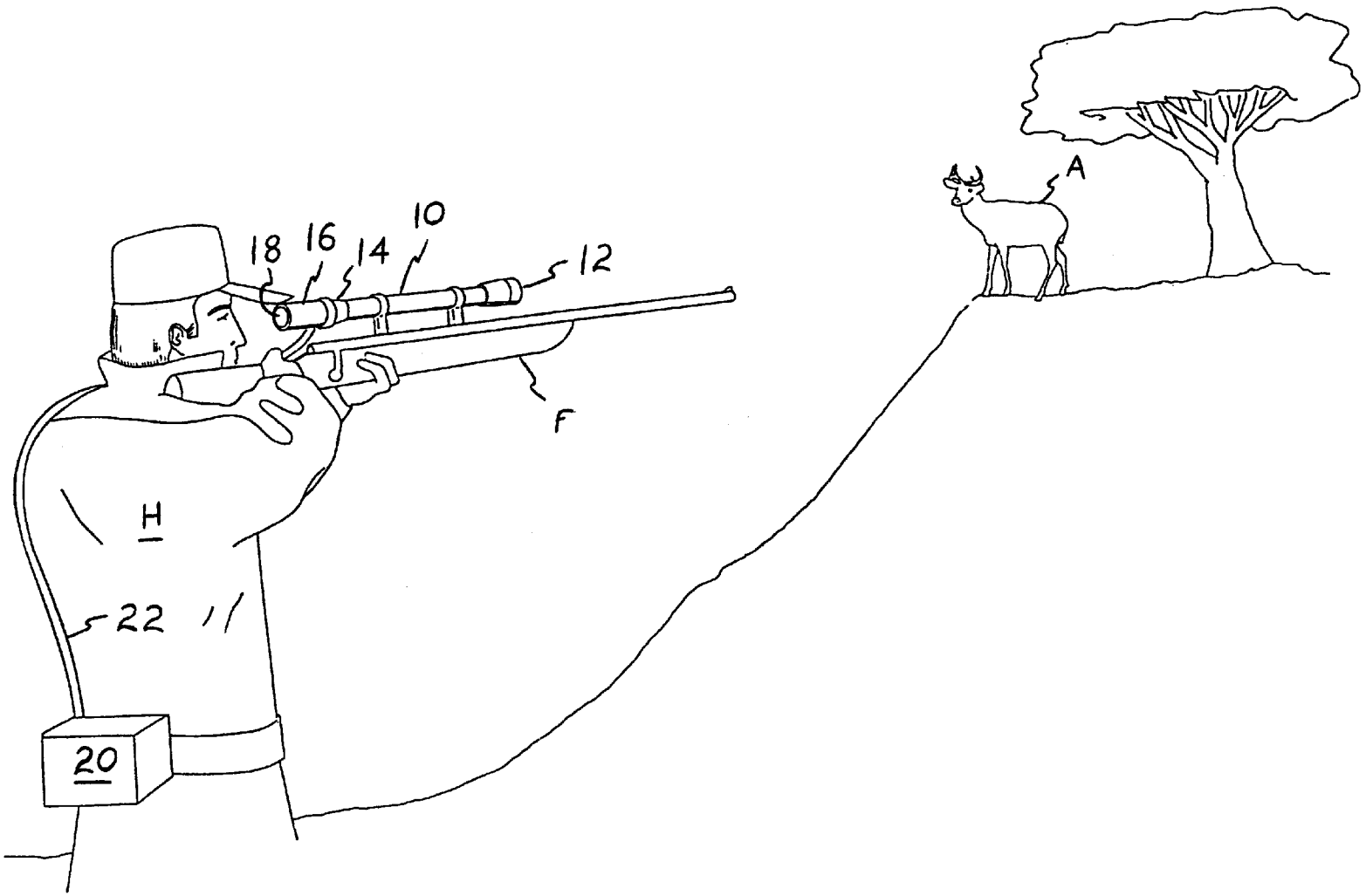
FIG. 1 is an environmental perspective view of the present optical imaging device in use with a firearm mounted scope, showing its general configuration and components.

FIG. 1 provides an illustration of the general concept of the present invention, in which a hunter H is preparing to fire a rifle or firearm F at a deer or game animal A. The firearm F is equipped with a telescopic sight or scope 10, with the scope 10 having a forward or objective end 12 and an opposite rearward or eyepiece end 14. The scope 10 shown in FIG. 1 is equipped with electronic optical imaging and receiving means comprising a miniature video camera or minicam 16, concentrically aligned with and removably secured to the eyepiece end 14 thereof. Such micro cameras 16 are conventional, and thus no detailed description of such an instrument need be provided here. It is well known that such micro cameras 16 receive an optical or video image and may provide a view of that image by means of a rearwardly disposed screen 18 at their viewing end, while transmitting the image to a recording means 20 via a cable 22 or other means (radio frequency or RF transmission, etc.).

Figure 2:
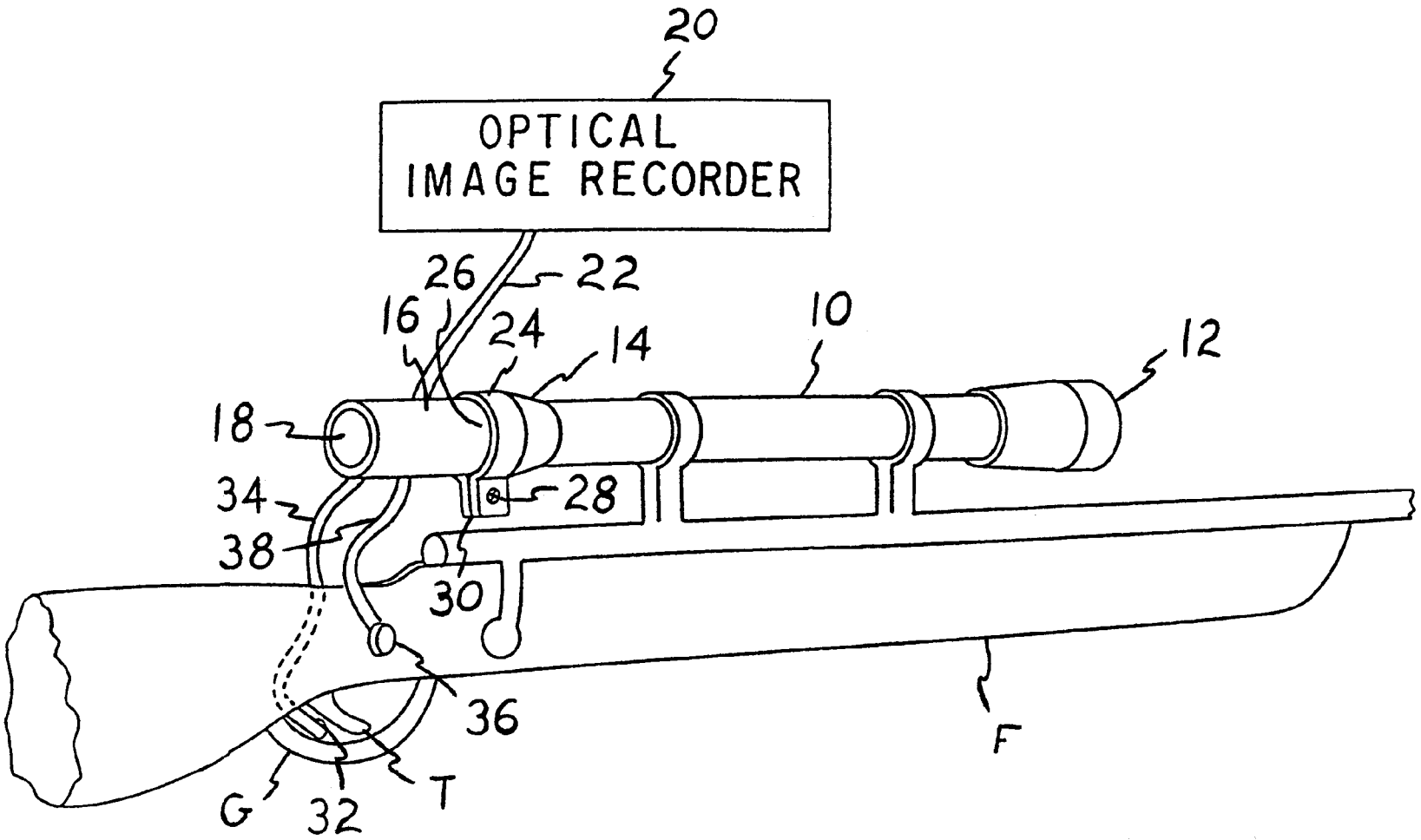
FIG. 2 is a broken away perspective view of a firearm and scope, illustrating the attachment of a micro camera to the eyepiece of the scope and actuating switch means for the system.

FIG. 2 provides a more detailed illustration of the apparatus shown generally in FIG. 1. In FIG. 2, the micro camera or minicam 16 is removably secured to the eyepiece end 14 of the scope 10 by means of an encircling clamp 24, which secures about the eyepiece end 14 of the scope 10 and the forward or objective end 26 of the micro camera 16. The clamp 24 may be a padded clamp, known in the trade as an Adel clamp, or other clamp means (e.g., worm gear type hose clamp, etc.) as desired. A removable or adjustable screw 28 may be provided with an Adel type clamp 24 to secure the two extended flanges 30 together.

FIG. 2 also discloses two different actuating means for operating the minicam 16 and recording means 20 of the present invention. The first actuating means provides for automatic operation of the camera 16 and recorder 20, by means of an electrical microswitch 32 positioned within the trigger guard G of the firearm F, immediately behind the trigger T. When the trigger T is pulled to fire the firearm F, the trigger T moves rearwardly to contact the microswitch 32, thereby closing its contacts to actuate the micro camera 16, and thus the recording means 20, via a cable 34 extending between the microswitch 32 and the microcam 16 and/or the video recording means 20. The system may be adjusted to actuate the camera 16 and recording means 20 just before the trigger T releases the firing pin to fire the weapon, and may include timer means (not shown), which may be adjusted to run for a few seconds thereafter as desired to capture the firing of the firearm F and the strike of the projectile on the target.

At times, it may not be desirable to fire the firearm F, even when the weapon is loaded and ready to fire. Accordingly, the present invention includes a supplemental electrical switch 36 remotely disposed from the trigger T and guard G, which may be actuated by thumb or finger contact as desired. The hunter H or person using the firearm F need only extend his or her thumb or finger upwardly and clear of the trigger guard G to close the contacts of a pushbutton or other switch 36 independently of the operation of the trigger T, actuating the camera 16 and recording means 20 by means of a supplemental cable 38.

Figure 3:
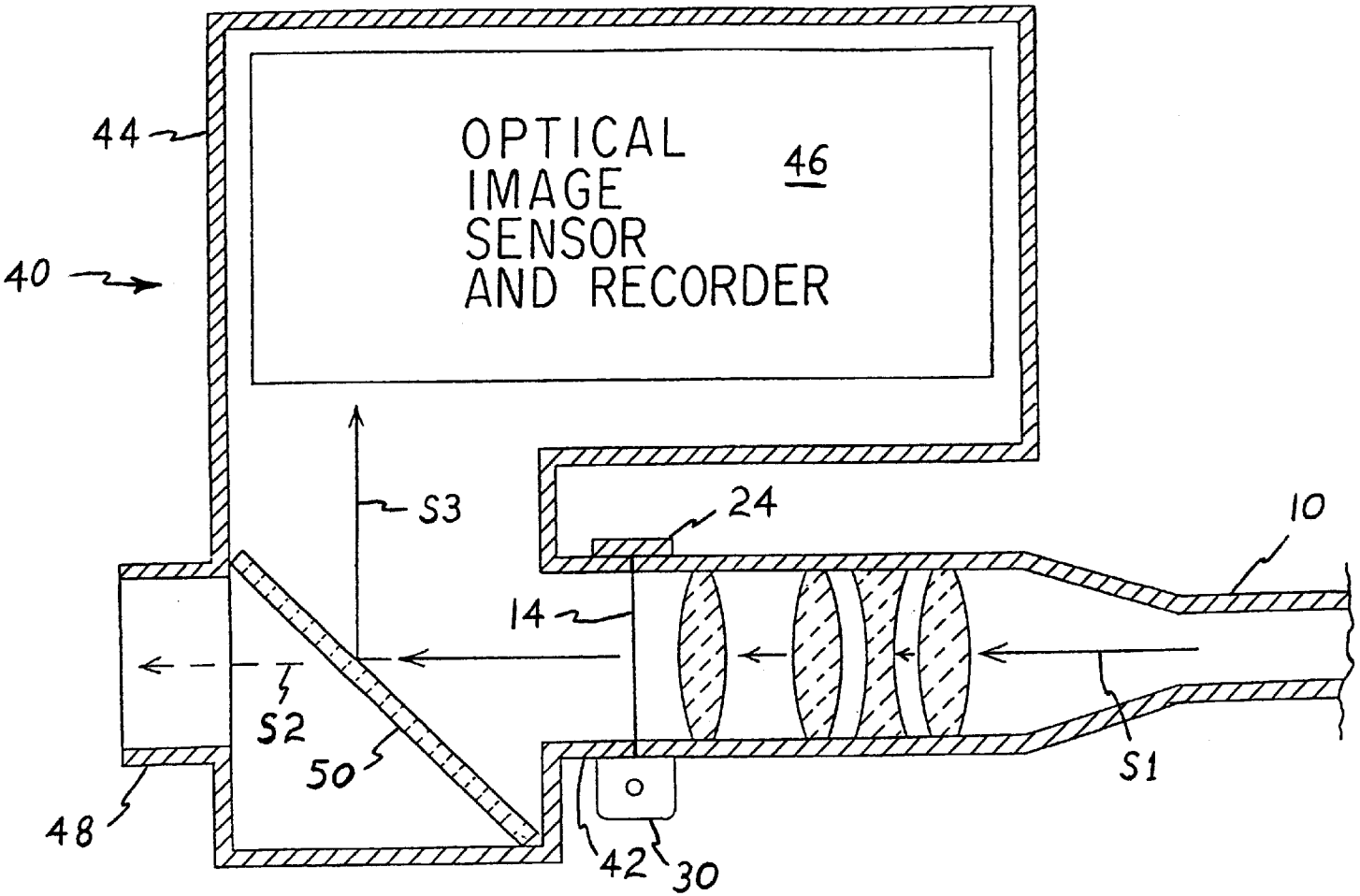
FIG. 3 is a side elevation view in section of the eyepiece end of a firearm scope, the axially offset installation of an optical recording device thereto, and means for passing the optical image to the device and to the viewer.

FIG. 3 provides a schematic side elevation view in section of an alternative means of carrying out the present invention, in which the electronic optical image sensing and recording means is contained within a housing 40. The housing 40 is in turn temporarily and removably secured to the eyepiece end 14 of the scope 10, e.g. by means of an Adel clamp 24 as used for securing the micro camera 16 to the scope 10 in FIG. 2, or other suitable means as desired. The clamp 24 secures about the eyepiece end 14 of the scope 10 and about the scope eyepiece attachment portion 42 of the housing 40, thus securing the attachment portion 42 of the housing 40 concentrically to the scope 10 as shown in FIG. 3.

The housing 40 further includes a camera holder portion 44, which is radially offset from the optical line of sight S1 of the scope 10. The camera holder portion 44 is sufficiently large as to hold any practicable electronic optical image sensing and recording means 46 as desired, such as a conventional digital still camera capable of capturing from one to a few frames when actuated, or a conventional videotape recording device which may run for one or more seconds to capture the image viewed through the scope 10. It will be seen that the device of FIG. 3 provides for the entire apparatus to be self contained, with no external recording means and power supply, such as the belt attached recording means 20 illustrated in FIG. 1 of the drawings, being required with the apparatus of FIG. 3.

The scope eyepiece attachment portion 42 of the housing 40 includes a rearwardly disposed viewing port or eyepiece 48 opposite thereto, enabling the hunter H or shooter to view the optical image along the line of sight S2 from the scope 10. A half silvered mirror 50 is disposed within the eyepiece attachment portion 42 of the housing 40 between the forward scope attachment end and the rearward eyepiece end 48 at a forty five degree angle to the line of sight S1 of the image passing through the scope 10, and passes a portion of the image passing through the scope 10 along the line of sight S1, through the mirror 50 to the viewing port or eyepiece 48 via the concentric line of sight S2. The remainder of the image is reflected radially outwardly from the line of sight S1 to the optical image sensing and recording means 46 contained within the camera holder portion 44 of the housing 40, and is optically aligned with the mirror 50 along the radial line of sight S3. The mechanism may be actuated by the means illustrated in FIG. 2 of the drawings and discussed further above.

Figure 4:
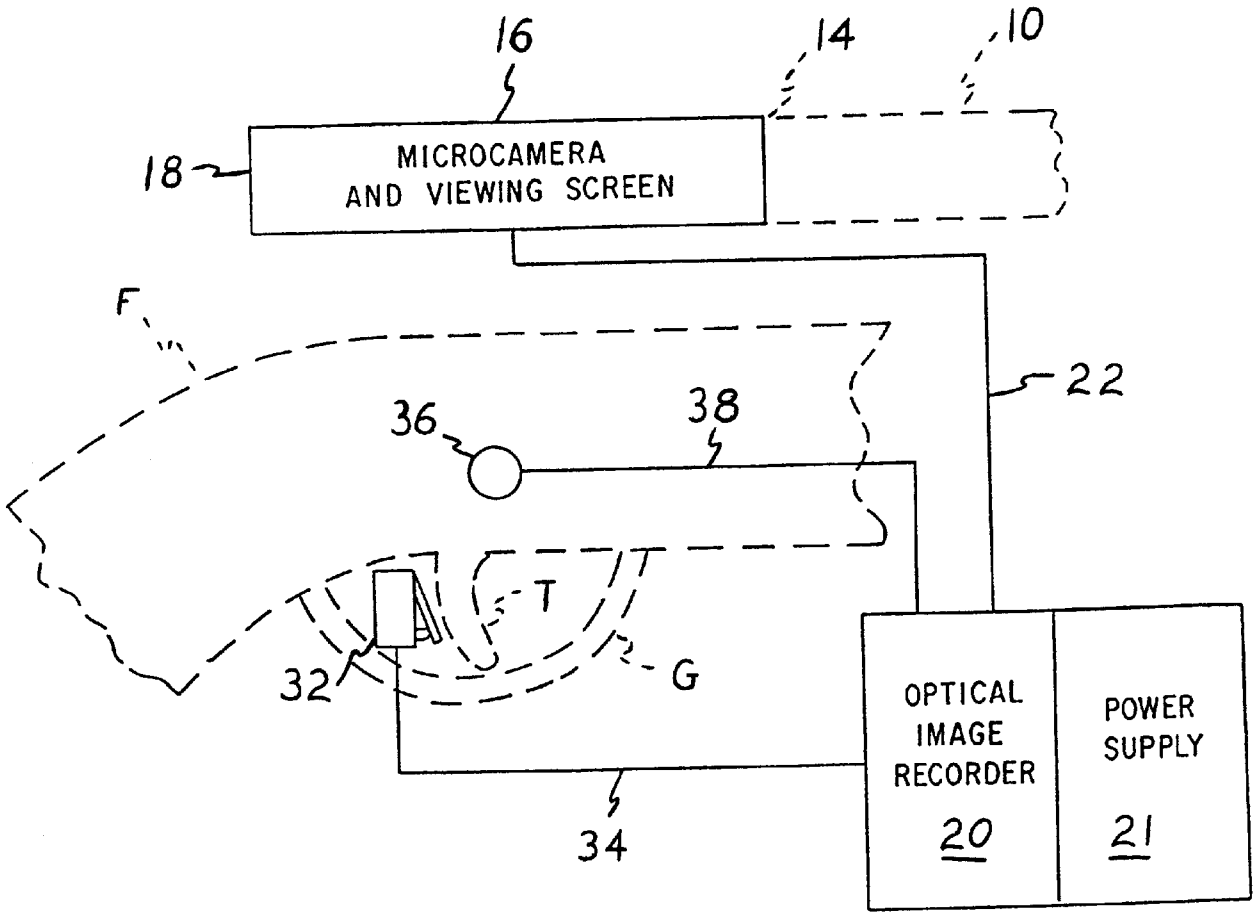
FIG. 4 is a schematic block diagram showing the major components of one embodiment of the present system and their relationship to one another and to a firearm with which they are installed.

FIG. 4 provides a schematic illustration of the arrangement of the miniature camera 16 and remotely located optical image recording means 20 and associated electrical power supply 21, along with the actuating switches (trigger switch 32 and supplemental switch 36). The two switches 32 and 36 and microcamera 16 communicate with the recording means 20 as indicated by the cable or other means 22, 34, and 38, and may either be hard wired to the recording means 20 or communicate therewith by radio frequency (rf) signals, as is known in the art.

In summary, the present invention provides various embodiments and means for interfacing optical imaging and recording means with the telescopic sight of a firearm. While the removable nature of the various components from the scope and firearm has been noted in the present disclosure, it will be noted that the present invention also lends itself to permanent installation with the scope, essentially as shown in FIG. 1 of the drawings. The separate components, such as the video recorder apparatus and its power supply, may be linked to the video camera of the scope by removably attachable cables, as shown, or by RF links, as desired. The use of a conventional miniature camera also provides further benefits, in that such a camera may be installed directly to the back of the scope and may preclude any requirement for corrective lenses or the like for hunters or shooters who might otherwise require such. Accordingly, the benefits of the present invention extend far beyond the capturing of an image of a game animal during a hunt, to assisting the shooter in sighting in a weapon and scope, and other benefits as well. The present invention in its various embodiments will prove to be a popular accessory with most hunters and shooters who have occasion to use scope equipped firearms.

It is to be understood that the present invention is not limited to the embodiments described above, but encompasses any and all embodiments within the scope of the following claims.

I claim:

1. An optical imaging device in combination with a hand held trigger actuated firearm having a magnifying scope sight with an eyepiece, comprising:

a hand held trigger actuated firearm;

a magnifying scope sight with an eyepiece attached to said firearm;

electronic optical imaging and recording means communicating with the eyepiece of the scope, and receiving a visual image therefrom;

said electronic optical imaging and recording means further including means aligned concentrically with the eyepiece of the scope for providing a visual image therefrom to a user of the firearm; and actuation means for automatically operating said electronic optical imaging and recording means;

wherein said actuation means is selected from the group of a microswitch disposed behind the trigger of the firearm and a supplemental electrical switch remotely located from the trigger of the firearm.

2. The optical imaging device according to claim 1, further including means for removably attaching said electronic optical imaging and recording means to the scope of the firearm.

3. The optical imaging device according to claim 1, wherein said electronic optical imaging and recording means further comprises:

a housing including a scope eyepiece attachment portion for securing concentrically to the eyepiece of the scope, and a camera holder portion radially offset from said scope eyepiece attachment portion;

wherein said means for providing a visual image is a rearwardly disposed viewing port formed within said scope eyepiece attachment portion of said housing;

a half silvered mirror disposed within said scope eyepiece attachment portion of said housing and positioned behind the eyepiece of the scope and in front of said viewing port, for transmitting a portion of the light from the scope to said camera holder portion of said housing and further passing a portion of the light therethrough to said viewing port; and an electronic optical recording device disposed within said camera holder portion of said housing, and optically aligned with said half silvered mirror for receiving and recording an optical image reflected therefrom.

4. The optical imaging device according to claim 3, wherein said electronic optical recording device is selected from the group consisting of digital still cameras and videotape recording devices.

5. The optical imaging device according to claim 1, wherein said electronic optical imaging and recording means further comprises:

an electronic optical image receiving device disposed concentrically with the eyepiece of the scope, for receiving an optical image therefrom;

wherein said means for providing a visual image is a viewing screen rearwardly disposed with said electronic optical image receiving device, for viewing the optical image passing through the eyepiece of the scope; and an electronic optical recording device remotely disposed from said electronic optical image receiving device and communicating therewith.

6. The optical imaging device according to claim 5, wherein said electronic optical image receiving device further comprises a micro camera.

* * * * *